US007398629B2

(12) United States Patent
Long et al.

(10) Patent No.: US 7,398,629 B2
(45) **Date of Patent: *Jul. 15, 2008**

(54) FLEXIBLE CARTON LOADING APPARATUS

(75) Inventors: Leslie Thomas Long, Appleton, WI (US); Emory Emil Luebke, Greenville, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 410 days.

This patent is subject to a terminal disclaimer.

(21) Appl. No.: 11/437,943

(22) Filed: May 19, 2006

(65) Prior Publication Data

US 2006/0207222 A1 Sep. 21, 2006

Related U.S. Application Data

(63) Continuation of application No. 11/023,836, filed on Dec. 27, 2004, now Pat. No. 7,073,310.

(51) Int. Cl.
*B65B 63/04* (2006.01)

(52) U.S. Cl. ..... 53/429; 53/117; 53/255; 53/566

(58) Field of Classification Search ..... 53/117, 53/120, 255, 429, 566
See application file for complete search history.

(56) References Cited

U.S. PATENT DOCUMENTS

| | | | | | |
|---|---|---|---|---|---|
| 3,053,024 | A * | 9/1962 | Wexler | 53/120 |
| 3,640,050 | A * | 2/1972 | Nystrand et al. | 53/120 |
| 3,656,271 | A * | 4/1972 | O'Shea et al. | 53/429 |
| 3,919,827 | A * | 11/1975 | Larson et al. | 53/429 |
| 4,751,807 | A * | 6/1988 | Couturier | 53/429 |
| 5,704,191 | A * | 1/1998 | Wallace et al. | 53/116 |
| 6,202,392 | B1 * | 3/2001 | Greenwell et al. | 53/566 |
| 6,305,146 | B1 * | 10/2001 | Gerber | 53/116 |
| 6,349,525 | B1 * | 2/2002 | Veith | 53/429 |
| 6,446,416 | B1 * | 9/2002 | Kuhn et al. | 53/445 |
| 6,910,600 | B2 | 6/2005 | Keberlein | |
| 7,073,310 | B1 * | 7/2006 | Long et al. | 53/429 |
| 2004/0016211 | A1 * | 1/2004 | Osborne et al. | 53/429 |
| 2004/0144795 | A1 | 7/2004 | Keberlein | |

(Continued)

FOREIGN PATENT DOCUMENTS

| | | |
|---|---|---|
| GB | 1325842 | 8/1973 |

*Primary Examiner*—Rinaldi I. Rada
*Assistant Examiner*—Gloria R. Weeks
(74) *Attorney, Agent, or Firm*—Gregory E. Croft

(57) ABSTRACT

By loading both upright and flat tissue clips into their respective cartons by pushing on one end of the clip along the clip's longitudinal axis, a simple flexible carton loading apparatus is possible. To load flat tissue clips, the buckets of the carton loading apparatus are configured to hold the clip such that a pusher head contacts one end of the clip while sliding the clip from the bucket into the carton. To load upright tissue clips, the buckets of the carton loading apparatus are configured to hold the clip such that a pusher head contacts one end of the clip, while the opposing end of the clip is moved either up or down such that the leading half of the clip is folded backwards about a transverse fold axis by a folding plate attached to the pusher head as the clip is advanced through the bucket towards the carton. Upon entering the carton, the clip is folded in a backwards C-shape.

15 Claims, 16 Drawing Sheets

U.S. PATENT DOCUMENTS

2006/0000190 A1 * 1/2006 Behnke et al. ..... 53/399
2006/0049067 A1 3/2006 McDonald
2006/0049074 A1 3/2006 Long et al.
2006/0102644 A1 5/2006 Long et al.

* cited by examiner

FLEXIBLE CARTON LOADING APPARATUS

BACKGROUND

This application is a continuation of U.S. patent application Ser. No. 11/023,836 filed on Dec. 27, 2004 now U.S. Pat. No. 7,073,310 and entitled "Flexible Carton Loading Apparatus", which is herein incorporated by reference.

Sheet materials, such as tissue, are often sold in a dispenser that frequently comprises a paperboard carton. There are two common packaging formats that have found widespread usage in the tissue industry. These two formats include a "flat" tissue carton and an "upright or boutique" tissue carton. In the flat tissue carton, the tissue clip inside the carton is not folded but instead the clip is a flat stack of individually folded tissue sheets. Flat tissue cartons have a rectangular top and bottom and come in various heights depending on the sheet count of the tissue clip. In the upright tissue carton, the tissue clip is typically folded into a U-shape and then inserted into a carton. Upright tissue cartons have a square top and bottom and are generally cubical in shape.

In existing machines to load tissue clips into flat cartons, the clip is pushed from the end along the longitudinal central axis of the clip into the carton. In existing machines to load tissue clips into upright cartons, the clip is first folded into a U-shape and then pushed from the side along the clip's transverse central axis into the carton. Thus, the orientation of the clip with respect to the open end of the carton differs by 90 degrees when loading the clip into the carton for the two common dispensing formats.

Because the clip is first folded into a U-shape and then placed into the bucket, an upright cartoner's bucket conveyor for loading upright clips requires a larger distance or pitch between the individual buckets than a flat cartoner's bucket conveyor for loading flat clips into flat cartons. Consequently, this can reduce the cartoner's output rate since the maximum output rate is related to the linear velocity of the bucket conveyer. Therefore, to load the same number of cartons per hour, an upright cartoner must run at a faster bucket conveyer line speed than a flat cartoner. This faster speed can result in the folded clip's position skewing and shifting within the conveyor bucket, resulting in either waste and delay or improperly folded clips in the finished product cartons.

Consumer preference for the two dispensing formats is split approximately evenly so a manufacturer, to be competitive, must sell each dispensing format. There are several options for meeting this consumer demand. First, a manufacturer can simply purchase at least one packaging machine to load each carton style. There would be dedicated machines to handle flat cartons and other dedicated machines to handle upright cartons. However, if there is insufficient demand to use each installed packaging machine at full capacity, this can result in an expensive option for the manufacturer; especially, considering that high speed cartoners for upright cartons typically cost 25-40 percent more than high speed cartoners for flat cartons. As consumer demand changes between the two formats, the dedicated machine option is not very flexible to meet changing production schedules.

Second, the packaging machine can be grade changed as necessary to switch between the two carton formats. This requires stopping production and then many changeover parts must be either added or removed to reconfigure the machine for properly loading the clip into the other style carton. As previously discussed, the pitch between flat buckets and upright buckets can be different and the clip loading method into the bucket must also be changed. Thus, changing between the two formats is not a simple matter. This can result in expensive production downtime, extra costs and inventory for changeover parts, and qualified mechanics to reconfigure the machine each time a change is required. Additional machine time or reduced productivity can be lost while adjusting the packaging machine once the changeover is made to optimize the machine for the new carton format.

Third, a dual format packaging machine, as disclosed in U.S. Pat. No. 6,202,392 entitled Flexible Tissue Handling Apparatus issued to Greenwell et al. on Mar. 20, 2001, and herein incorporated by reference, can be purchased. To package flat cartons, extensible pushers turn the tissue clips 90 degrees so they drop into transverse channels. Subsequently, flat overhead tamps descend and the tissue clips are pushed through guide buckets into the end of the flat cartons. To package upright cartons, the extensible pushers are disengaged so the lengths of the tissue clips remain in the machine direction spanning the transverse channels. Subsequently, narrow tamps descend, pushing the center of the tissue clips into the transverse channels, forming the tissue clips into the beginning of a U-shape ready for pushing through guide buckets into the side of the boutique cartons. Generally, the clips in either case are received in individual buckets of a bucket conveyor, and, in the appropriate configuration, are loaded into cartons moving along a machine direction in phased relation to the buckets. A transfer guide bucket conveyor is typically interposed between the buckets and the cartons for receiving and guiding the configured clip as it is pushed transversely from the bucket into the carton.

This option, however, requires the purchase of expensive new machines to replace the previous packaging machines. Capital spending can have a long payback period in the highly competitive tissue business; especially, if the older packaging machines have been fully depreciated but still have acceptable production rates. Additionally, all the clips are initially placed with their longitudinal axis aligned in the machine direction which requires a larger distance between individual buckets and consequently reduces machine speed potential when loading flat cartons compared to a dedicated flat cartoner. Rotating the clip 90 degrees when running flat grades also limits the speed potential and can lead to increased waste and delay from the additional handling step. The clip can become twisted or otherwise diverge from its uniform stacked configuration during rotation and this can cause jamming of the machinery or lead to improperly loaded cartons.

Therefore, what is needed is a method and apparatus that can load both flat and upright cartons on the same packaging machine that requires a minimum of downtime when changing from one carton format to the next. Also, what is needed is a method and apparatus that is compatible with existing packaging machines, including high speed models, such that they can be easily converted into a flexible carton loading apparatus with a minimum of expense. Additionally, what is needed is an apparatus that can load flats and uprights with bucket spacing or pitch similar to a flat cartoner such that productivity when loading flats is not compromised and productivity when loading uprights is increased.

SUMMARY

The inventors have discovered that by loading both upright and flat tissue clips into their respective cartons by pushing on the end of the clip along the clip's longitudinal axis in both cases, a simple flexible carton loading apparatus is possible. To load flat tissue clips, the buckets of the carton loading apparatus are configured to hold the clip such that a pusher head contacts one end of the clip while sliding the clip from the bucket into the carton. To load upright tissue clips, the buckets of the carton loading apparatus are configured to hold the clip such that a pusher head contacts one end of the clip, while the opposing end of the clip is moved either up or down such that the leading half of the clip is folded backwards about a transverse fold axis by a folding plate attached to the pusher head as the clip is advanced through the bucket and toward the carton. Upon entering the carton, the clip is folded in a backwards C-shape. This new clip folding process can be implemented within an automated carton loading machine used to load flat cartons or used as a stand alone operation.

To retrofit existing packaging lines, new buckets and pushers with quick change parts can be utilized, significantly reducing the capital expenditure required over a new machine, while maintaining the same bucket spacing or pitch of the existing machine. Alternatively, new packaging machines can be designed to operate in this manner when increased demand justifies the additional production capacity. Since the previously required clip rotation step of Greenwell is eliminated, the packaging machines can be more compact and operate more efficiently. Conversion between the two dispensing formats can be accomplished with a minimum of downtime since the clip is pushed from the end along its longitudinal axis to load both flats and uprights.

Hence, in one aspect, the invention resides in a method comprising the steps of: placing a clip into a bucket, the clip having a longitudinal central axis passing through a first and a second end; advancing the clip towards a container by a pusher assembly contacting either the first or the second end of the clip, the pusher assembly moving in a direction parallel to the longitudinal central axis of the clip; folding the clip about a transverse fold axis as the clip advances in the bucket; and loading the folded clip into the container.

In another aspect, the invention resides in an apparatus comprising: a bucket having an open pusher end, an open container end, and a floor; a pusher assembly having a pusher head and a folding plate extending past the pusher head disposed adjacent the open pusher end of the bucket; the pusher assembly configured for back and forth motion within at least a portion of the bucket; and a guide ramp disposed within the bucket and configured for movement with respect to the floor between and an inclined position and a lowered position.

In another aspect, the invention resides in an apparatus comprising: a bucket having an open pusher end, an open container end, and a floor having a recess or aperture; a pusher assembly having a pusher head and a folding plate extending past the pusher head disposed adjacent the open pusher end of the bucket; the pusher assembly configured for back and forth motion within at least a portion of the bucket; a clip ramp disposed within the bucket adjacent the open pusher end of the bucket and located beneath at least a portion of the pusher assembly's back and forth motion; and a guide ramp disposed within the bucket and configured for movement between a declined position and a raised position.

BRIEF DESCRIPTION OF THE DRAWINGS

The above aspects and other features, aspects, and advantages of the present invention will become better understood with regard to the following description, appended claims, and accompanying drawings in which:

Figure 1:
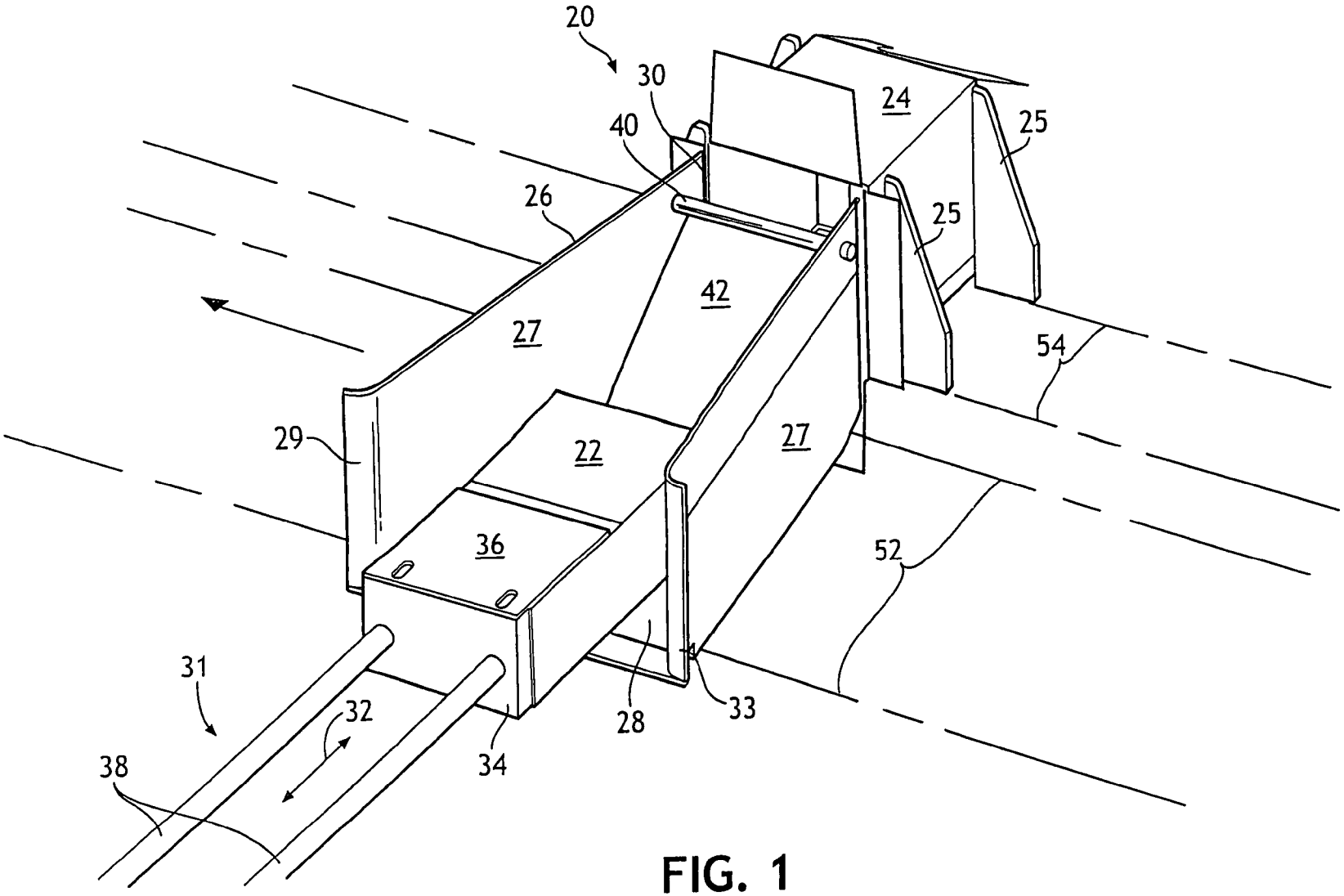
FIG. 1 illustrates a top perspective view of one embodiment of the invention.

Repeated use of reference characters in the specification and drawings is intended to represent the same or analogous features or elements of the invention.

Definitions

As used herein, forms of the words "comprise", "have", and "include" are legally equivalent and open-ended. Therefore, additional non-recited elements, functions, steps, or limitations may be present in addition to the recited elements, functions, steps, or limitations.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

Figure 2:
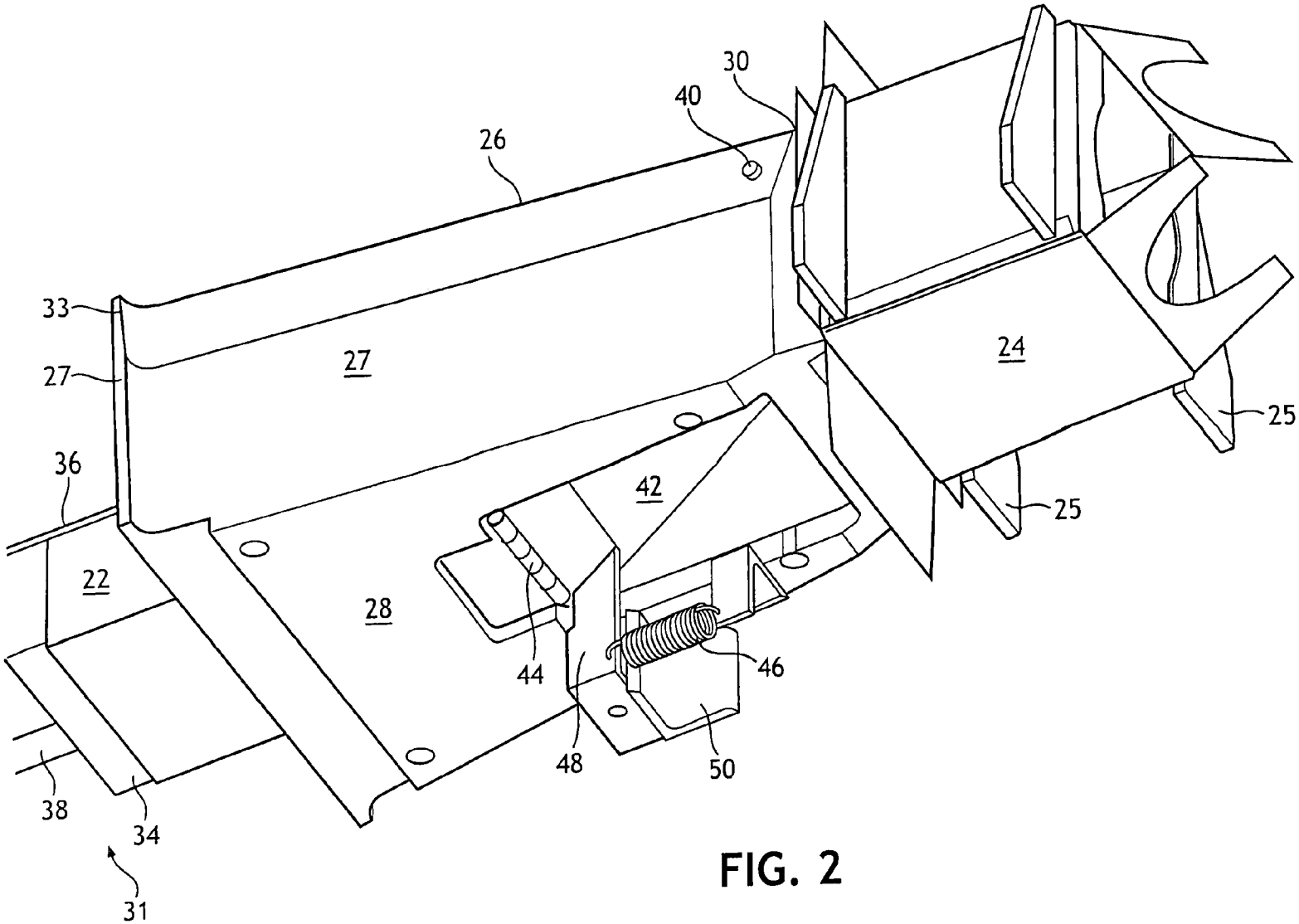
FIG. 2 illustrates a bottom perspective view of the embodiment of FIG. 1.

Referring now to FIGS. 1 and 2, an apparatus 20 for loading a clip 22 into a carton 24 held by a plurality of carton lugs 25 is shown. The apparatus includes a bucket 26 for guiding the clip into the carton. The bucket may have two upstanding walls 27 and a floor 28 such that the bucket has an open top and open opposing ends. The bucket may have a funnel shape such that the bucket tapers from an open pusher end 29 to an open carton end 30 for assistance in guiding the clip into the carton, or the bucket may have parallel upstanding walls 27. The open pusher end 29 may further comprise a radius or lip 33 for assistance in guiding the clip into the bucket. The size or shape of the bucket can be varied depending on the clip's configuration such as the clip's sheet count, type of sheet material contained by the clip, whether the clip is wet or dry, and the overall size of the clip (length, width, and height). The bucket acts to guide the clip first into the bucket and then into the carton as the clip is advanced through the bucket into the carton.

For the purposes of illustration, the clip is shown extending past the pusher end 29 of the bucket 26 in FIGS. 1 and 2. In various embodiments of the invention, the clip can extend past the pusher end 29 as shown, be approximately even with the pusher end 29, or the clip can be disposed entirely within the bucket some distance past the pusher end 29 when initially loaded into the bucket.

A pusher assembly 31 configured for back and forth motion as indicated by double headed arrow 32 is disposed adjacent the pusher end 29 of the bucket. The pusher assembly includes at least a pusher head 34 and a folding plate 36 to load upright cartons. The folding plate 36 can be eliminated when loading flat cartons. The pusher assembly is used to advance the clip along the bucket and into the carton. The pusher assembly may include a linkage 38 connected to a cam or other mechanical assembly known to those of skill in the art for effecting back and forth motion of the pusher head and folding plate.

The apparatus 20 further includes a folding bar 40 spanning the bucket's upstanding wall's 27 disposed nearer the carton end 30 of the bucket, adjacent one end of a guide ramp 42 pivotally connected to the bucket such that the guide ramp can move between an elevated position as shown and a lowered position parallel with the floor 28. The guide ramp 42 may be a separate piece attached to the bucket with a hinge 44 or the guide ramp could be a portion of the bucket's floor that is partially cutout and attached to the bucket with a living hinge. Alternatively, the guide ramp 42 could be flexible material that is attached to the bucket such as a piece of spring steel that can be flexed between the raised and lowered positions.

The guide ramp 42 can be biased in an elevated position by a spring 46 having one end attached to an arm 48 extending from the guide ramp or the hinge. The arm 48 is held against a stop 50 by the spring's force, thereby holding the guide ramp in a predetermined elevated position, as shown. Alternately, the bucket and guide ramp can be a unitary assembly molded from a suitable plastic such that the guide ramp is elevated as shown, but due to the flexibility of the material, it can flex and pivot to a lowered position. In this embodiment, it may be possible to eliminate the spring and rely on the elasticity or modulus of the material forming the guide ramp for springing the ramp into an elevated position. A guide ramp fabricated from a piece of spring steel and attached to the bucket can be used to function in this manner.

Figure 4:
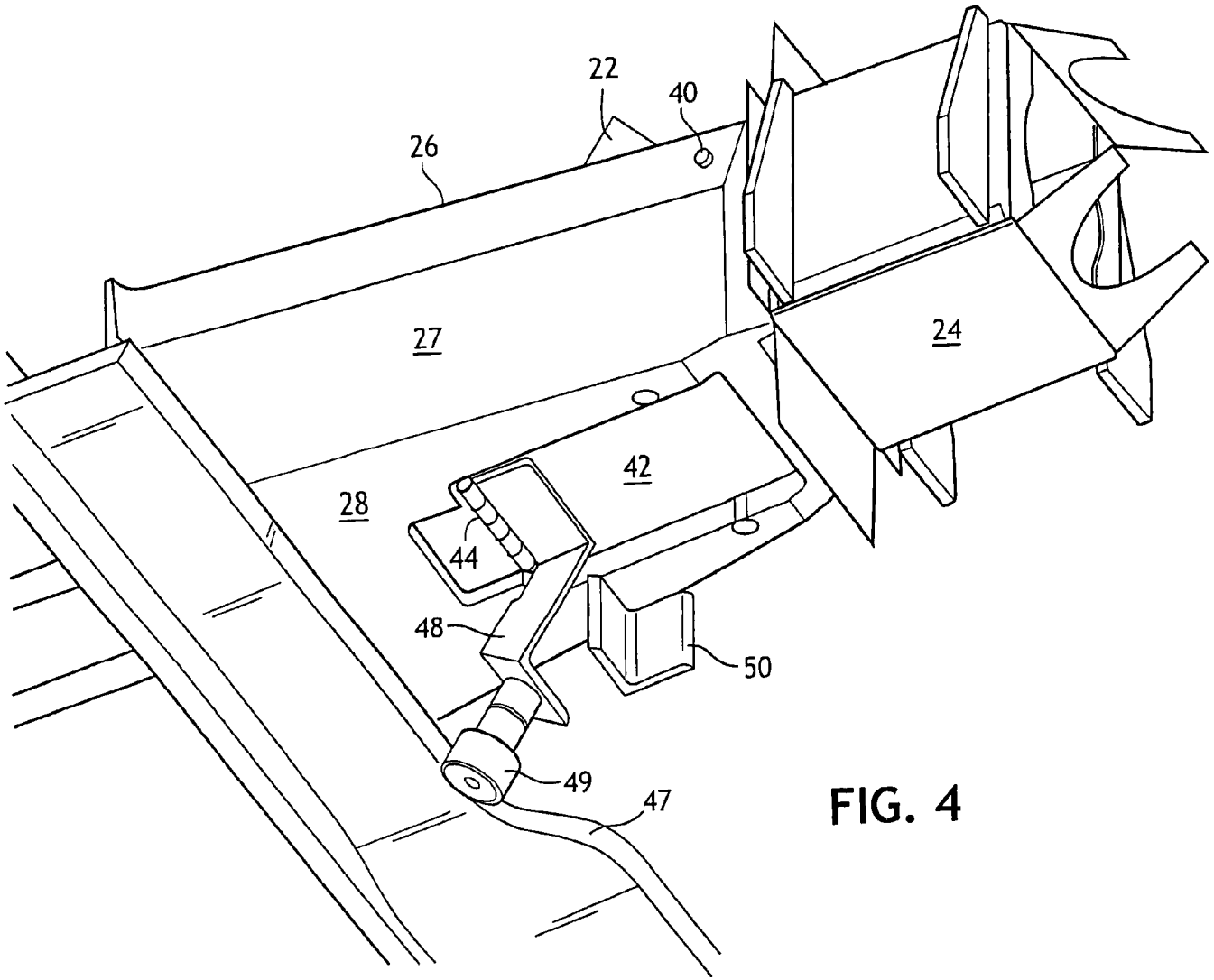
FIG. 4 illustrates a bottom perspective view of an alternative embodiment of the invention.

Various mechanical components can be used to move the guide ramp between an elevated position and a lowered position or to pivot the guide ramp up and down about one end attached to the bucket. As seen in FIG. 4, the spring 46 is replaced by a cam 47 and a cam follower 49 attached to the arm 48. In other embodiments, an actuator, a stepper motor, a torsion spring, a linkage or other combination of mechanical elements known to those of skill in the art can be substituted for the hinge 44, the spring 46, the cam 47, the arm 48, and/or the stop 50 to affect movement of the guide ramp as required. Additionally, as previously discussed, the elasticity of the material forming the guide ramp 42 can provide the required motion.

The apparatus 20 can be used for loading an individual carton or multiple apparatuses can be incorporated into an automated cartoner. When adapting the invention to a cartoner, multiple buckets can be attached to a bucket conveyer 52, multiple cartons can be conveyed by a carton conveyer 54 with multiple carton lugs 25, and multiple pusher assemblies 31 can be actuated to various extended positions for simultaneous filling of multiple cartons as the cartons and buckets are advanced in relation to one another by the respective conveyors. The dashed lines in FIG. 1 are used to imply linear motion of the various parts along the conveyor paths. Typically, the bucket and carton conveyors form an endless loop having a linear horizontal portion for loading clips into the cartons.

Figure 7:
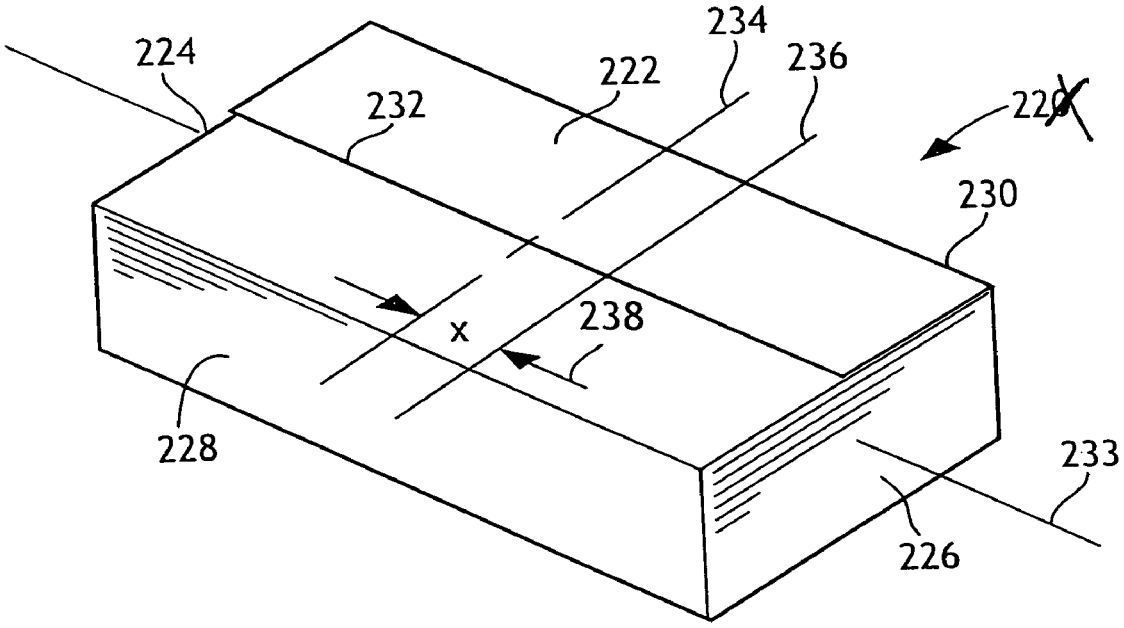
FIG. 7 illustrates a perspective view of a clip of sheet material.

Prior to discussing how the apparatus of FIGS. 1 and 2 folds a clip, more information about the clip 22 is presented. Referring now to FIG. 7, a clip 22 of sheet material 222 is illustrated. The clip 22 comprises a specific number of individual sheets. If desired, the sheets can be folded prior to stacking them to form the clip. Alternatively, individual non-folded sheets could be stacked to form the clip. The sheets within the clip can be either interfolded for pop-up dispensing, joined together by weaken lines such as perforations for pop-up dispensing, or individually folded for reach in dispensing. The clip has a first 224 and a second 226 opposing end and a first 228 and a second 230 opposing side. The sides of the clip are longer than the depth or width of the ends. Typically, a free end 232 of the sheet material is positioned near the center of the clip and aligned with the longitudinal central axis 233. This helps to position the first sheet of the clip beneath a dispensing opening after the clip is placed into a dispenser. The clip also has an upper transverse central axis 234 and an upper transverse fold axis 236. In one embodiment, the clip is folded about the upper transverse fold axis 236 located an offset distance X (reference numeral 238) to either side of the upper transverse central axis 234. In another embodiment, the offset distance X is zero such that the clip is folded about the upper transverse central axis 234.

Figure 8:
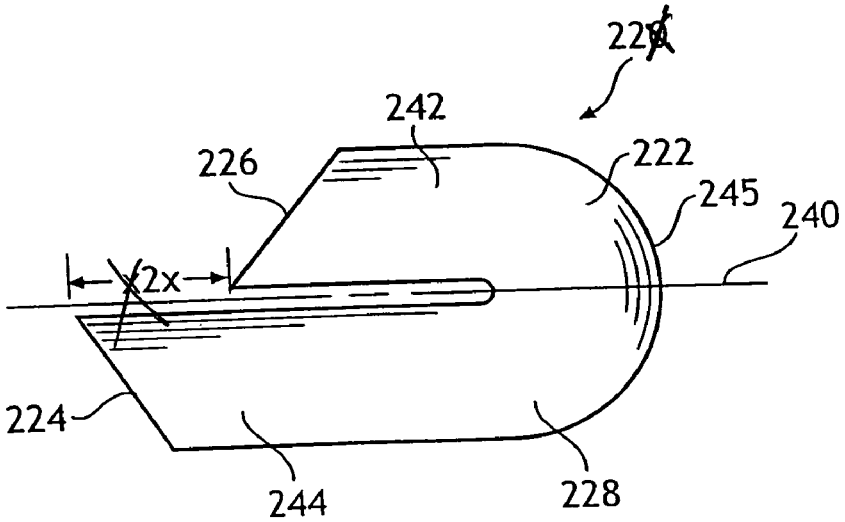
FIG. 8 illustrates a side view of the clip of FIG. 7 folded about a transverse axis.

When folded about an offset upper transverse fold axis, the clip 22 assumes a J-shape as shown in FIG. 8. When the offset distance x is zero, the clip is folded into a symmetrical U-shape or backwards C-shape. Once folded, the clip 22 has a longitudinal fold axis 240 where the first clip portion 242 or upper portion of the clip touches or lies adjacent to the second clip portion 244 or lower portion of the clip. The clip also has a folded end 245 located opposite the first and second ends (224, 226). The second end 226 is offset a distance of approximately 2X relative to the first end 224 when folded about the upper transverse fold axis 236. Additionally, the first and second ends (224, 226) become angled or slanted relative to the longitudinal fold axis 240 since the radius of curvature for each sheet increases as you move outwards from the inside to the outside of the folded clip. In various embodiments of the invention, the offset distance X can be between about 0 mm to about 70 mm, or between about 0 mm to about 40 mm, or between about 0 mm to about 20 mm, or between about 0 mm to about 10 mm.

Referring now to FIGS. 3A-3F, the clip loading sequence for the apparatus 20 of FIGS. 1 and 2 is illustrated. For convenience, the sequences will be discussed as if the apparatus is part of an automated cartoner. Additionally, one of the bucket walls 27 has been removed for clarity in seeing how the clip is manipulated by the apparatus. Upstream of the carton loading apparatus, a clip 22 is loaded into one of the buckets 26 of the bucket conveyor 52 by a clip loading apparatus. Similarly, a carton 24 with the closing flaps open is loaded onto the carton conveyer 54 by an upstream carton feeding and erecting apparatus. The carton, bucket, and pusher assemblies are advanced along their respective paths within the cartoner until the pusher head 34 contacts either the first or the second end (244 or 226) of the clip 22. As the pusher assembly advances within the bucket, the folding plate 36 is positioned above one end of the clip.

To fold a U-shaped or backward C-shaped clip, the free end 37 of the folding plate 36 should extend from the pusher head 34 by a distance approximately equal to ½ the length of the clip. This will cause the clip to be folded about the upper transverse central axis 234 of the clip. To fold a J-shaped clip, the folding plate should be positioned to extend either less than or more than ½ the length of the clip. This will cause the clip to be folded about the upper transverse fold axis 236 at an offset distance X from the upper transverse central axis. The amount of offset distance X can be controlled by how far the folding plate 36 extends from the pusher head 34. The dimension of the offset distance X, relative to the upper transverse central axis 234, can be controlled by the extension of the folding plate. Thus it is possible to make the first clip portion either shorter (as illustrated in FIG. 8) or longer than the second clip portion 244.

Figure 3A:
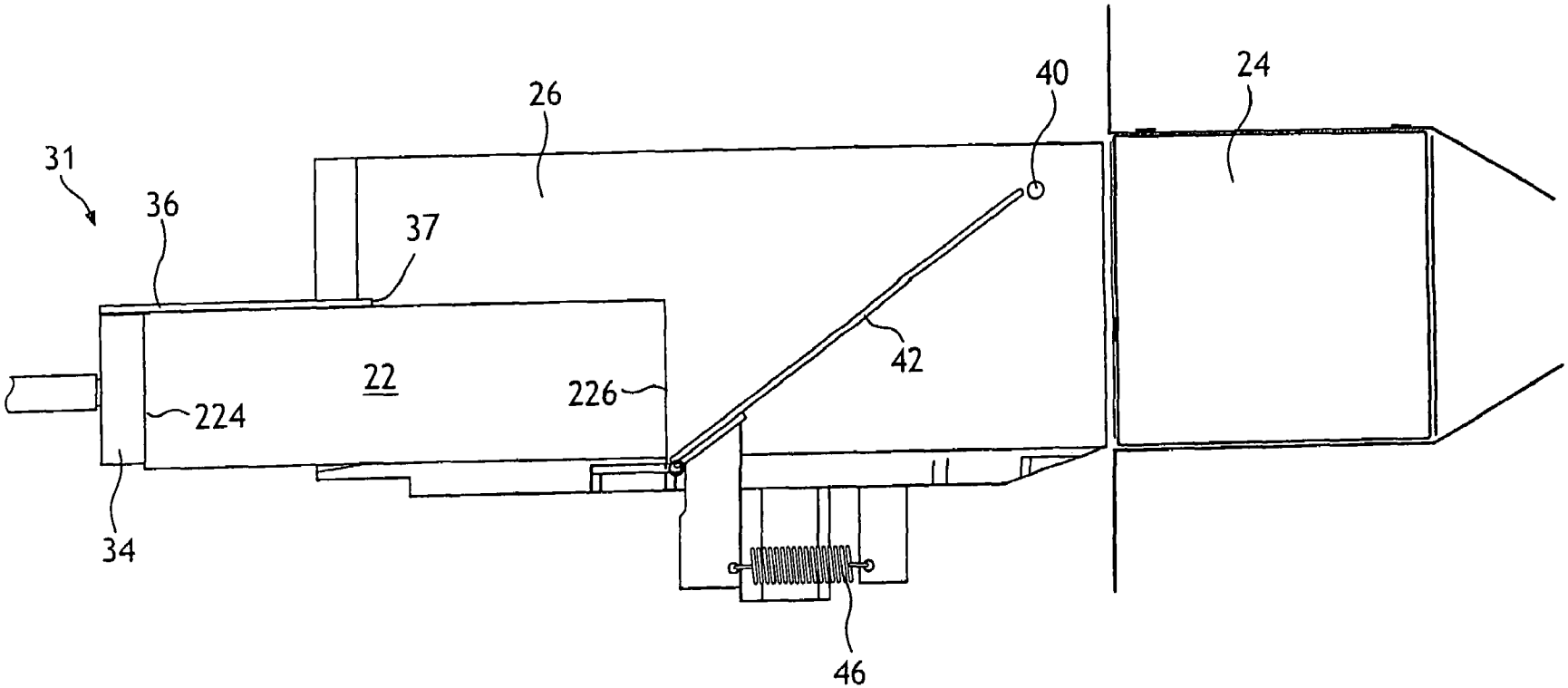
FIGS. 3A-3F illustrate a loading sequence of the embodiment of FIG. 1.
Figure 3B:
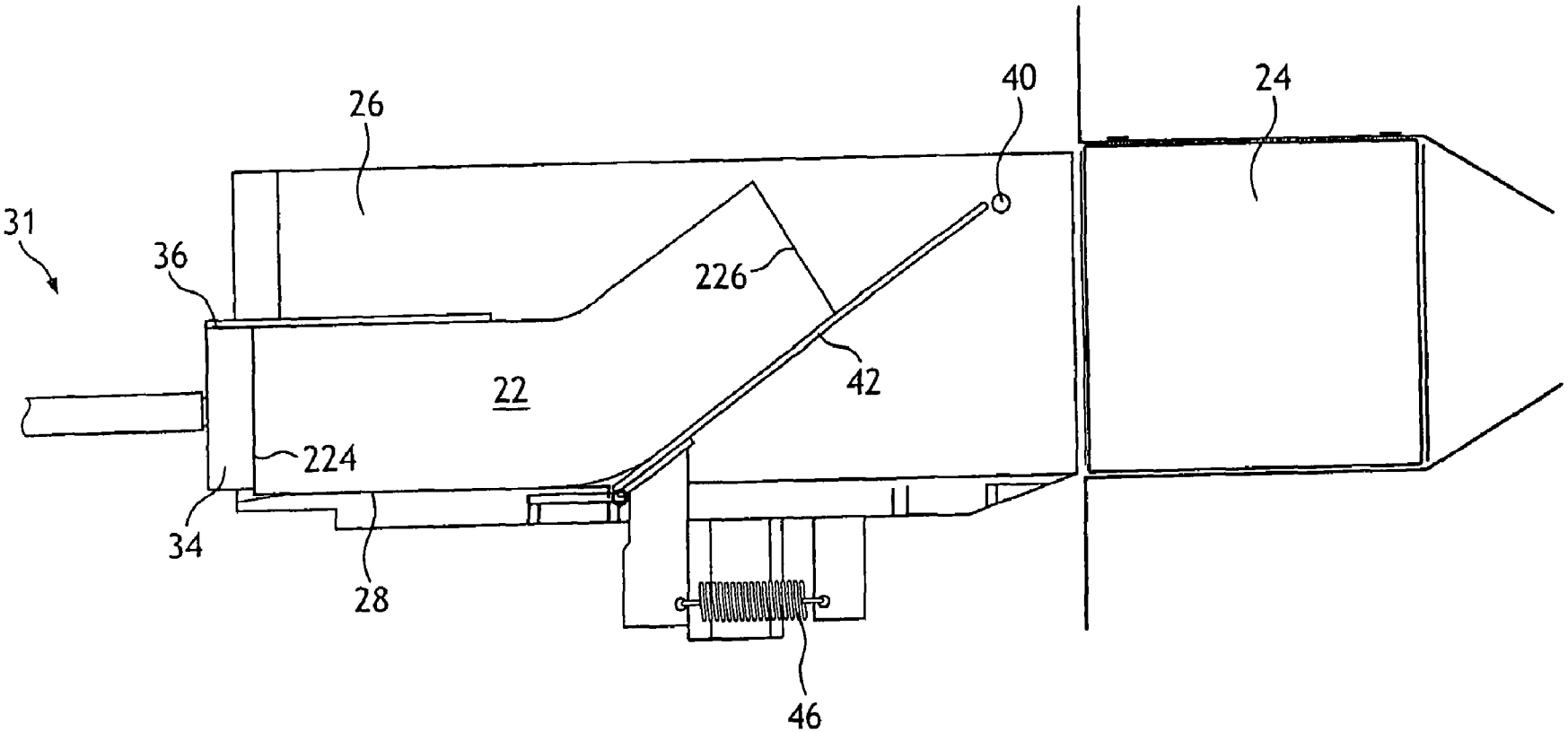

As shown in FIG. 3B, the carton 24, bucket 26, and pusher assembly 31 continue to advance along their respective paths as the pusher assembly advances into the bucket pushing the clip 22 up the guide ramp 42. The clip, owing to the flexibility of the sheet material, begins to bend as the second end 226 is elevated while the first end 224 is restrained between the folding plate 36 and the floor 28 of the bucket.

Figure 3C:
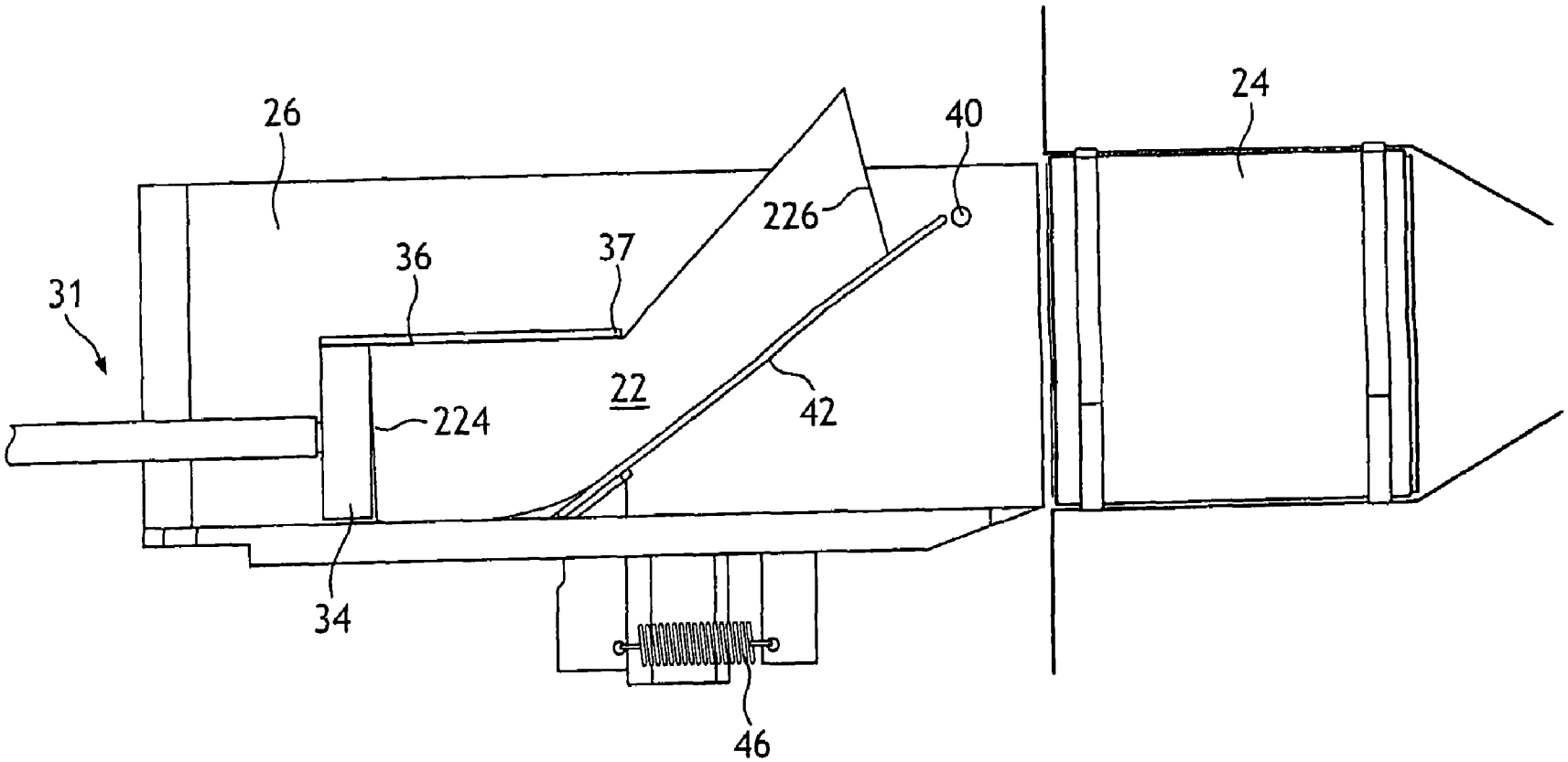

As shown in FIG. 3C, the clip 22 continues to advance up the guide ramp 42 until the clip is pinched between the free end 37 of the folding plate and the guide ramp 42. At this point, clip advancement up the guide ramp is halted and the second end 226 of the clip begins a process of being folded backwards around the free end 37 of the folding plate 36.

Figure 3D:
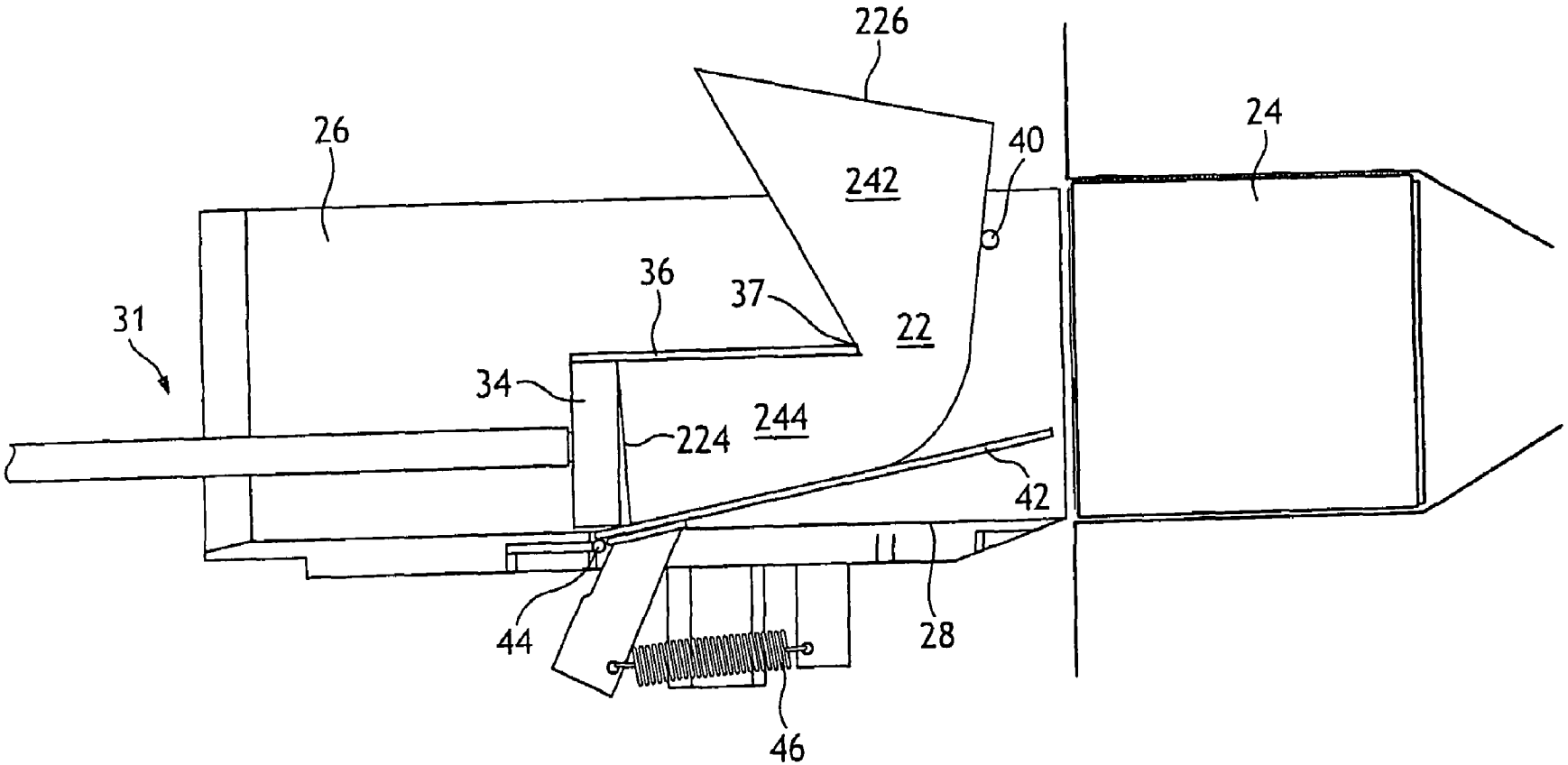

As shown in FIG. 3D, the pusher assembly 31 continues to advance causing the force of the clip 22 against the guide ramp 42 to overcome the force of the spring 46 biasing the guide ramp 42 in an elevated position. At this point, the guide ramp begins to pivot about the hinge 44 moving towards the floor 28 of the bucket. At some point during this motion, the first clip portion 242 contacts the folding bar 40 further folding the first clip portion 242 around the free end 37 of the folding plate 36. In another embodiment of the invention, the folding bar 40 is eliminated and the carton's open end can be used to fold the first clip portion 242 backwards over the folding plate 36.

Figure 3E:
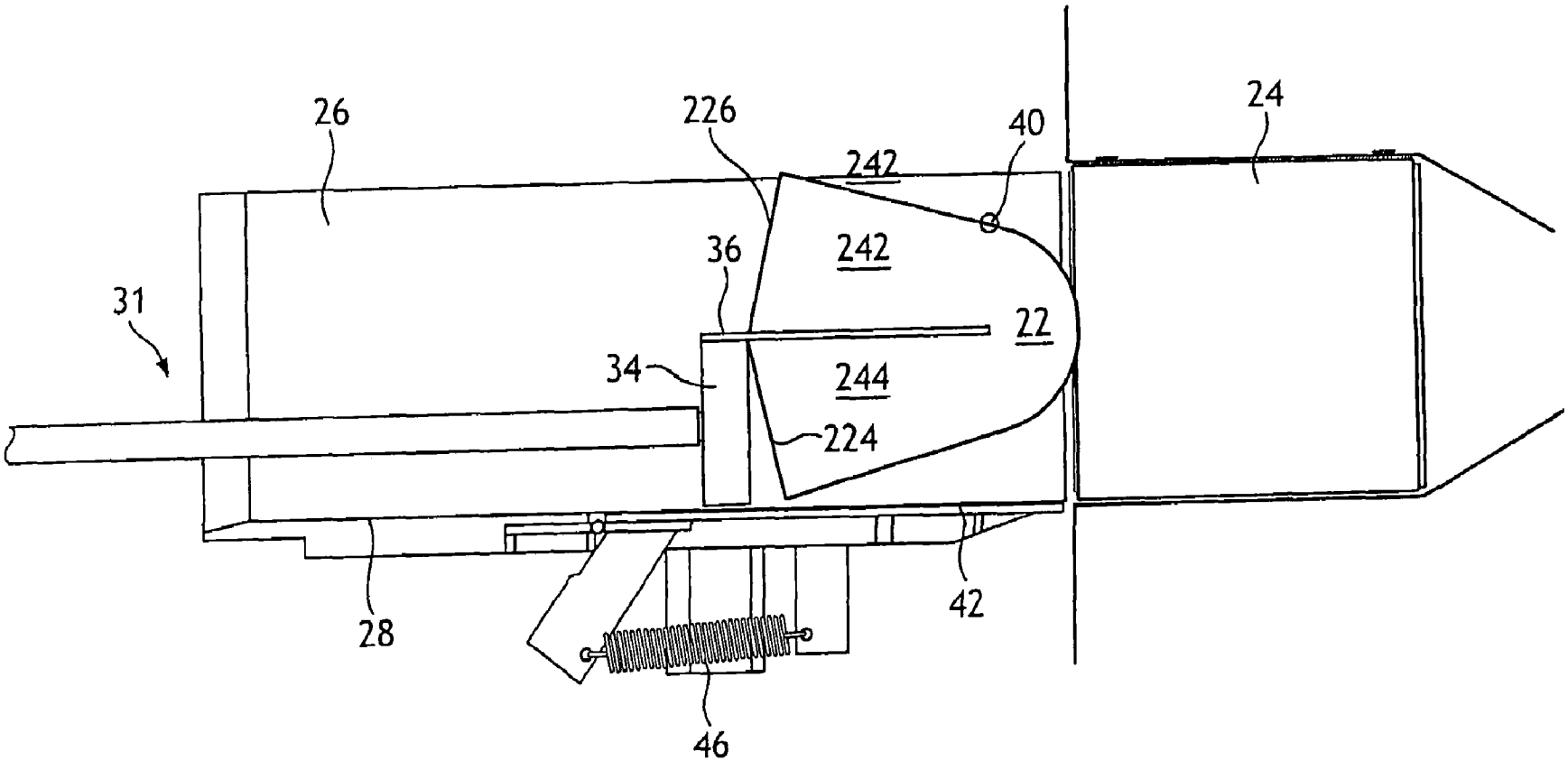

As shown in FIG. 3E, the pusher assembly 31 continues to advance such that the first clip portion 242 is folded by the folding bar 40 and the folding plate 36 over the top of the second clip portion 244 to form either a U-shaped or J-shaped clip. In this position, the guide ramp 42 is fully pivoted into its lower position lying parallel with the floor 28 by contact with the bottom surface of the pusher head 34.

As best seen in FIG. 1, the length of the folding plate 36 extending from the pusher head 34 is adjustable. One method to adjust the length of the folding plate is to use slotted holes and threaded fasteners to attach the plate to the head. Other mechanical elements known to those of skill in the art can be used to adjust the length of the folding plate. By extending or retracting the folding plate relative to the pusher head, the upper transverse folding axis 236 can be offset to either side of the upper transverse central axis 234 of the clip or aligned with the upper transverse central axis. This provides the flexibility to fold the clip about a transverse axis located at anywhere along the length of the clip. Such flexibility can be used to load higher sheet count clips into standard sized cartons as discussed in pending U.S. patent application Ser. No. 10/955,435 entitled Folded Clip and Dispenser filed on Sep. 30, 2004, and herein incorporated by reference.

Figure 3F:
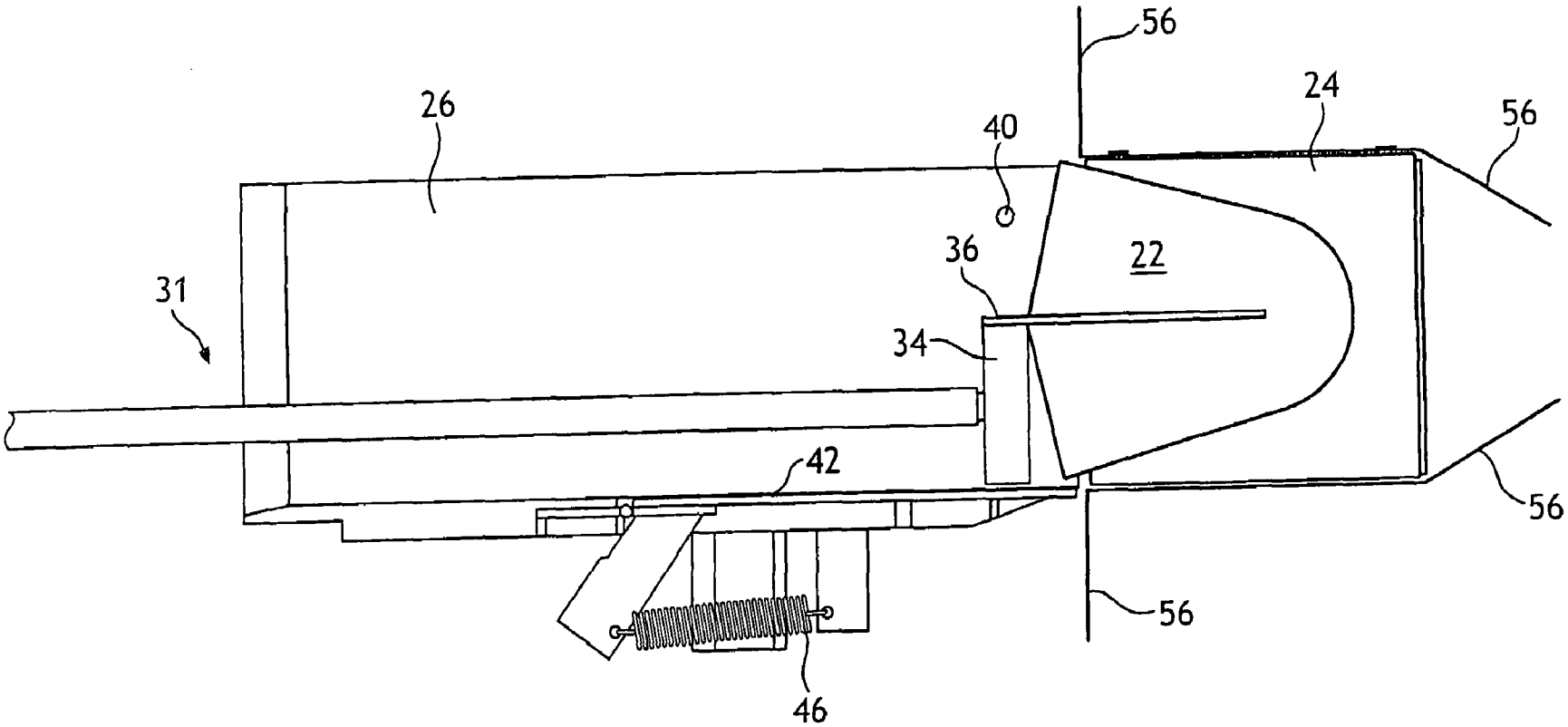

As shown in FIG. 3F, the clip loading sequence is completed as the pusher assembly 31 advances the folded clip 22 into the carton 24. Not shown, the carton 24, bucket 26, and pusher assembly 31 continue to advance along their respective paths as the pusher assembly is retracted out of the carton. The bucket conveyor 52 and the carton conveyor 54 diverge to enable the closing flaps 56 of the carton 24 to be folded and glued shut after which the carton is removed from the carton conveyer. Upon retraction of the pusher assembly 31, the guide ramp 42 returns to its elevated position by the force of spring 46. The bucket 26 continues around the bucket conveyor and returns to its initial point and a fresh clip is loaded into the bucket to start a new cycle.

FIGS. 3A-3F illustrate the loading sequence for filling upright or boutique cartons containing a folded clip. To fill flat tissue cartons, the apparatus 20 can be quickly grade changed with a minimum of expense and downtime. For low sheet count clips 22, the guide ramp 42 can be held down in its lowest position by one or more fasteners or combination of fasteners such as a screw, a spring pin, a detent, or a clip. Alternatively, the spring 46 can be removed and a fixed linkage installed to hold the guide ramp in the lowered position. So configured, a clip 22 loaded into the bucket will be pushed the pusher assembly 31 over the guide ramp 42 and into the carton along its longitudinal central axis without being folded about a transverse fold axis. The apparatus will load the clip into the carton in a manner similar to existing cartoners. For higher sheet count clips, the folding plate 36 and optional folding bar 40 may need to be removed to prevent interference with the clip. Alternatively, the folding plate 36, the folding bar 40, and the guide ramp 42 can be retracted from interfering with the clip when loading flat grades by appropriate mechanical linkages such that grade changing from flats to uprights can be done automatically if desired.

Figure 5:
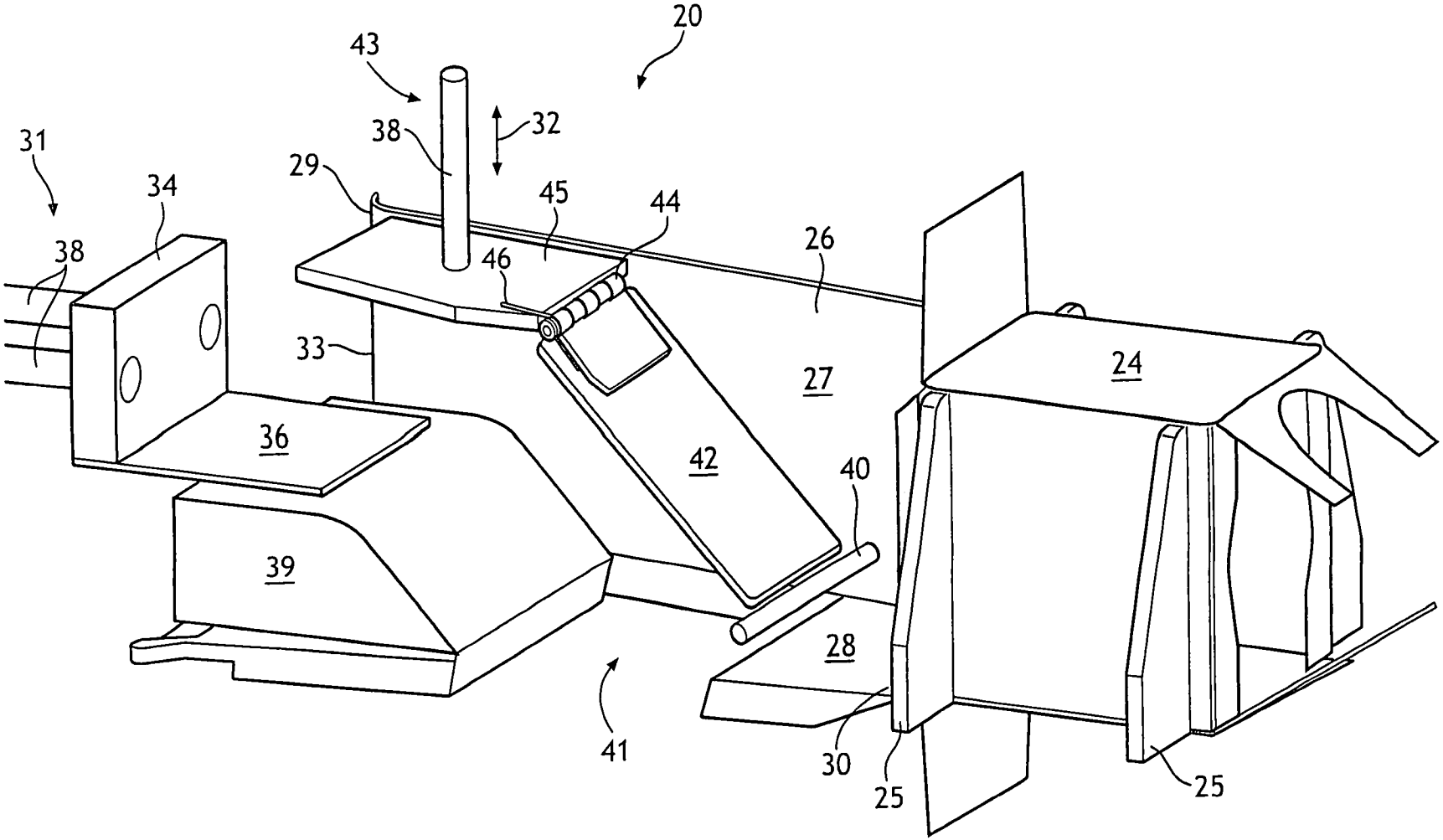
FIG. 5 illustrates a cutaway view of a perspective view of an alternative embodiment.

Referring now to FIGS. 5 and 6A-6E, an alternative embodiment of the apparatus 20 for loading a clip 22 into a carton 24 held by a plurality of carton lugs 25 is shown. In FIGS. 5 and 6A-6E, one of the bucket's walls 27 has been removed for clarity. Additionally, FIG. 5 shows a front perspective view of the apparatus, while FIGS. 6A-6E are an opposing side view of the same apparatus. In this embodiment, rather than elevating the second end of the clip 226 and then folding the first clip portion 242 backwards over the second clip portion 244, the second end 226 of the clip is lowered and the first clip portion 242 is folded backwards under the second clip portion 244.

The apparatus includes a bucket 26 for guiding the clip into the carton. The bucket may have two upstanding walls 27 (one removed in Figures) and a floor 28 such that the bucket has an open top and open opposing ends. The bucket may have a funnel shape such that the bucket tapers from an open pusher end 29 to an open carton end 30 for assistance in guiding the clip into the carton, or the bucket may have parallel upstanding walls 27. The open pusher end 29 may further comprise a radius or lip 33 for assistance in guiding the clip into the bucket. The size or shape of the bucket can be varied depending on the clip's configuration such as the clip's sheet count, type of sheet material contained by the clip, whether the clip is wet or dry, and the overall size of the clip (length, width, and height). The bucket acts to guide the clip first into the bucket and then into the carton as the clip is advanced through the bucket into the carton.

Figure 6A:
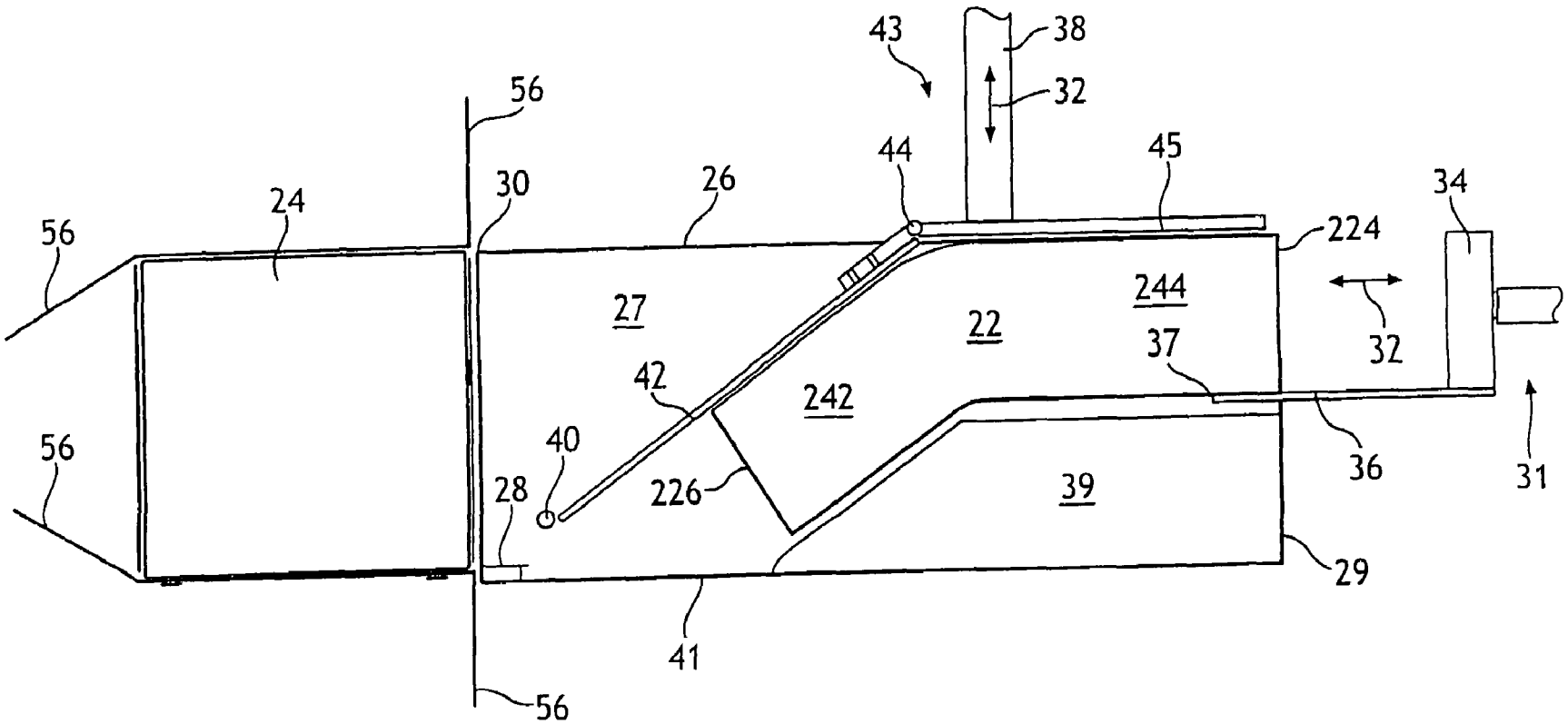
FIGS. 6A-6E illustrate a loading sequence of the embodiment of FIG. 5.

For the purposes of illustration, the clip is shown ending even with the pusher end 29 of the bucket 26 in FIG. 6A after the clip is initially loaded into the bucket. In various embodiments of the invention, the clip can extend past the pusher end 29, be approximately even with the pusher end 29, or the clip can be disposed entirely within the bucket some distance past the pusher end 29 when initially loaded into the bucket.

A pusher assembly 31 configured for back and forth motion is disposed adjacent the pusher end 29 of the bucket. The pusher assembly 31 includes at least a pusher head 34 and a folding plate 36 to load upright cartons. The folding plate 36 can be eliminated when loading flat cartons. The pusher assembly 31 is used to advance the clip along the bucket and into the carton. The pusher assembly 31 may include a linkage 38 connected to a cam or other mechanical assembly known to those of skill in the art for effecting back and forth motion of the pusher head and folding plate.

The apparatus further includes a clip ramp 39 disposed near the pusher end 29 of the bucket 26. The horizontal portion of the clip ramp nearer the pusher end 29 of the bucket elevates the first end 224 of the clip while the second end 226 of the clip is lower than the first end and is disposed adjacent the angled portion of the clip ramp as seen in FIG. 6A. The floor of the bucket 28 includes a recess, an aperture, or a cutout 41 for the clip to extend into as it is being folded about a transverse fold line while being advanced by the pusher assembly 31. In one embodiment, the recess was a square cutout that removed a portion of the bucket's floor 28.

The apparatus 20 further includes a folding bar 40 spanning to the bucket's walls 27 disposed near the carton end 30 of the bucket 26 adjacent one end of a guide ramp 42 pivotally connected to an overhead tamper 43 having a tamping plate 45 attached to a linkage 38. The overhead tamper is configured for up and down motion as indicated by arrow 32 using appropriate mechanical methods such as a cam and cam follower known to those of skill in the art. The guide ramp 42 can move between a declined position as shown and a raised position substantially parallel with the floor 28. The guide ramp 42 may be a separate piece attached to the tamping plate with a hinge 44, or the guide ramp could be a portion of the tamping plate and attached to the tamping plate with a living hinge. Alternatively, the guide ramp 42 could be flexible material that is attached to the tamping plate such as a piece of spring steel that can be flexed between the lowered and raised positions.

The guide ramp can be biased in a lowered position by a torsion spring 46, or the force of gravity acting on the guide ramp can cause it to be initially lowered. The guide ramp can be constrained between predetermined pivot angles by designing appropriate upper and lower stops. For example, an upper stop may prevent the guide ramp from rotating past the top of wall 27 and a lower stop may prevent the guide ramp from rotating past the position of the folding bar 40. The stops may be a separate piece attached to the apparatus or they may be designed into the hinge. It may be possible to eliminate the torsion spring 46 and rely on the elasticity or modulus of the material forming the guide ramp for biasing the guide ramp in a lowered position. A guide ramp fabricated from a piece of spring steel and attached to the tamping plate 45 can be used to function in this manner.

The apparatus 20 can be used for loading an individual carton, or multiple apparatuses can be incorporated into an automated cartoner. When adapting the invention to a cartoner, multiple buckets can be attached to a bucket conveyer, and multiple cartons can be conveyed by a carton conveyer with multiple carton lugs. Multiple pusher assemblies 31 and multiple overhead tampers 43 can be actuated to various extended positions for simultaneous filling of multiple cartons as the cartons and buckets are advanced in relation to one another by the respective conveyors. Typically, the bucket and carton conveyors form an endless loop having a linear horizontal portion for loading the clips into the cartons.

Referring now to FIGS. 6A-6F, the clip loading sequence for the apparatus 20 of FIG. 5 is illustrated. For convenience, the sequences will be discussed as if the apparatus is part of an automated cartoner. Additionally, one of the bucket walls 27 has been removed for clarity in seeing how the clip is manipulated by the apparatus. Upstream of the carton loading apparatus, a clip 22 is loaded into one of the buckets 26 of the bucket conveyor 52 by a clip loading apparatus. Similarly, a carton 24 with the closing flaps 56 open is loaded onto the carton conveyer 54 by an upstream carton feeding and erecting apparatus. The carton, bucket, and pusher assemblies are advanced along their respective paths within the cartoner until the tamper 43 contacts the clip and the folding plate 36 begins to slide underneath the clip. If desired, the clip ramp 39 can be designed with a groove for the folding plate to initially slide into for assistance in positioning the folding plate under the clip. Alternatively, the free end 37 of the folding plate can be V-shaped, tapered, or pointed for insertion under the last sheet of the clip.

To fold a U-shaped or backward C-shaped clip, the free end 37 of the folding plate 36 should extend from the pusher head 34 by a distance approximately equal to ½ the length of the clip. This will cause the clip to be folded about the upper transverse central axis 234 of the clip. To fold a J-shaped clip, the folding plate should be positioned to extend either less than or more than ½ the length of the clip. This will cause the clip to be folded about the upper transverse fold axis 236 at an offset distance X from the upper transverse central axis. The amount of offset distance X can be controlled by how far the folding plate 36 extends from the pusher head 34. The position of the offset distance X, relative to the upper transverse central axis 234, can be controlled by the extension of the folding plate. Thus, it is possible to make the first clip portion 242 either shorter (as illustrated in FIG. 8) or longer than the second clip portion 244.

Figure 6B:
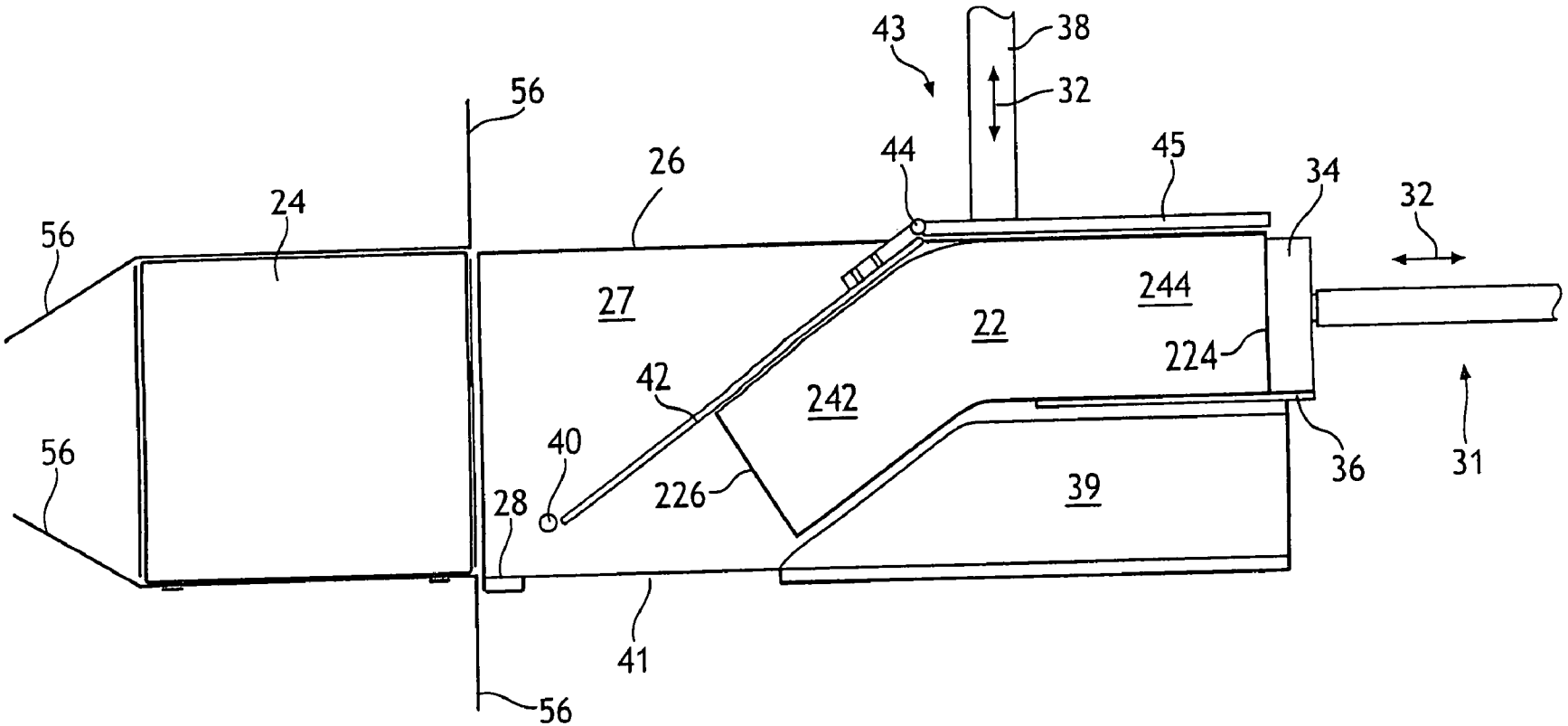
Figure 6C:
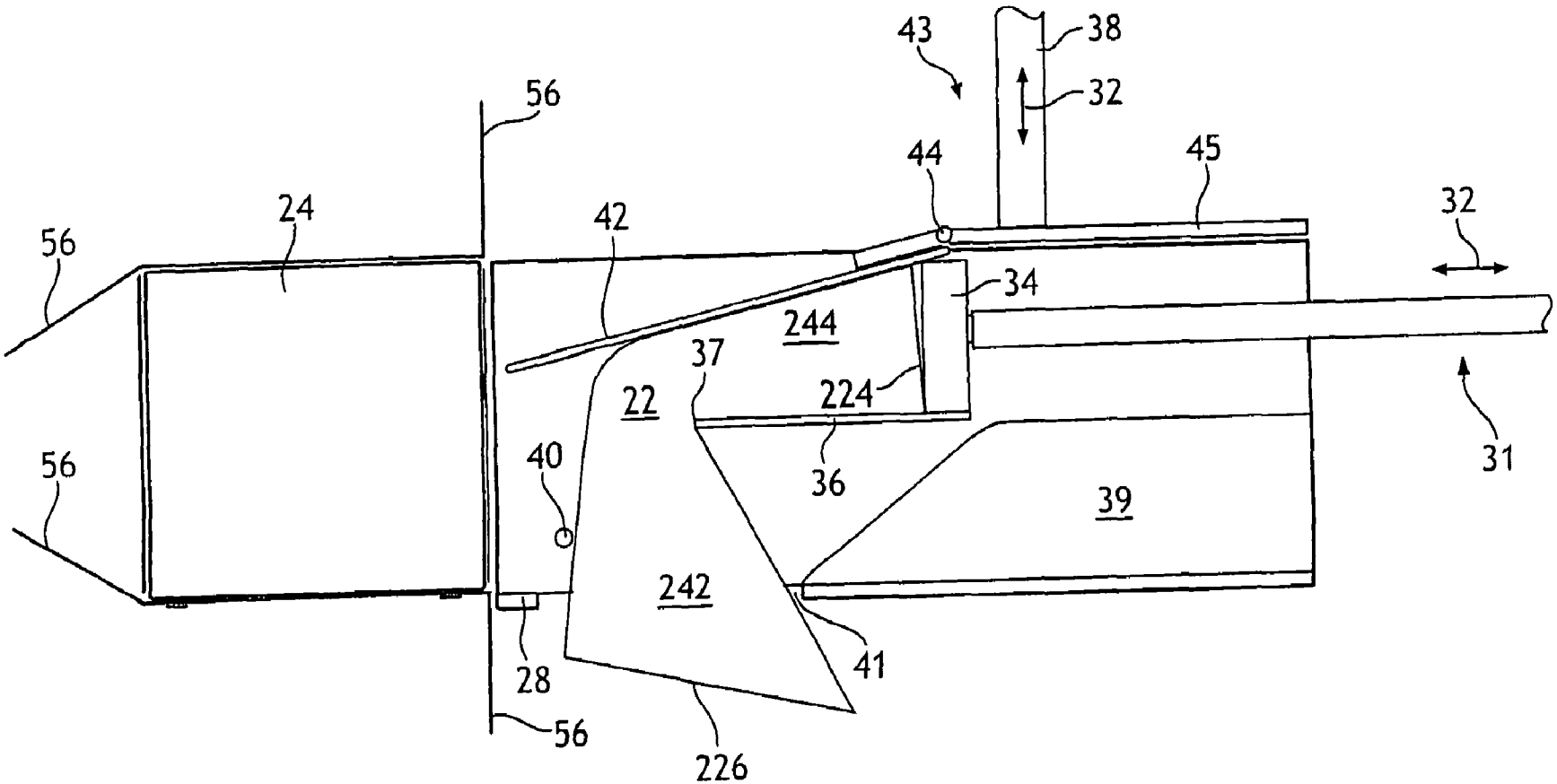

As shown in FIG. 6B, the carton 24, bucket 26, and pusher assembly 31 continue to advance along their respective paths as the pusher assembly 31 advances into the bucket pushing the clip 22 down the clip ramp 39. The clip, owing to the flexibility of the sheet material and from being held down by the guide ramp 42, begins to bend as the second end 226 is lowered while the first end 224 is restrained between the folding plate 36 and the tamping plate 45.

As shown in FIG. 3C, the clip 22 continues to be advanced by the pusher assembly 31 as the folding bar 40 directs the second end 226 of the clip into the hole or recess 41 in the bucket floor 28. The clip becomes pinched between the folding plate 36 and the guide ramp 42 as the guide ramp begins to pivot away from the folding bar 40 into a raised position. At this point, clip advancement is halted and the second end 226 of the clip begins a process of being folded backwards around the free end 37 of the folding plate 36.

Figure 6D:
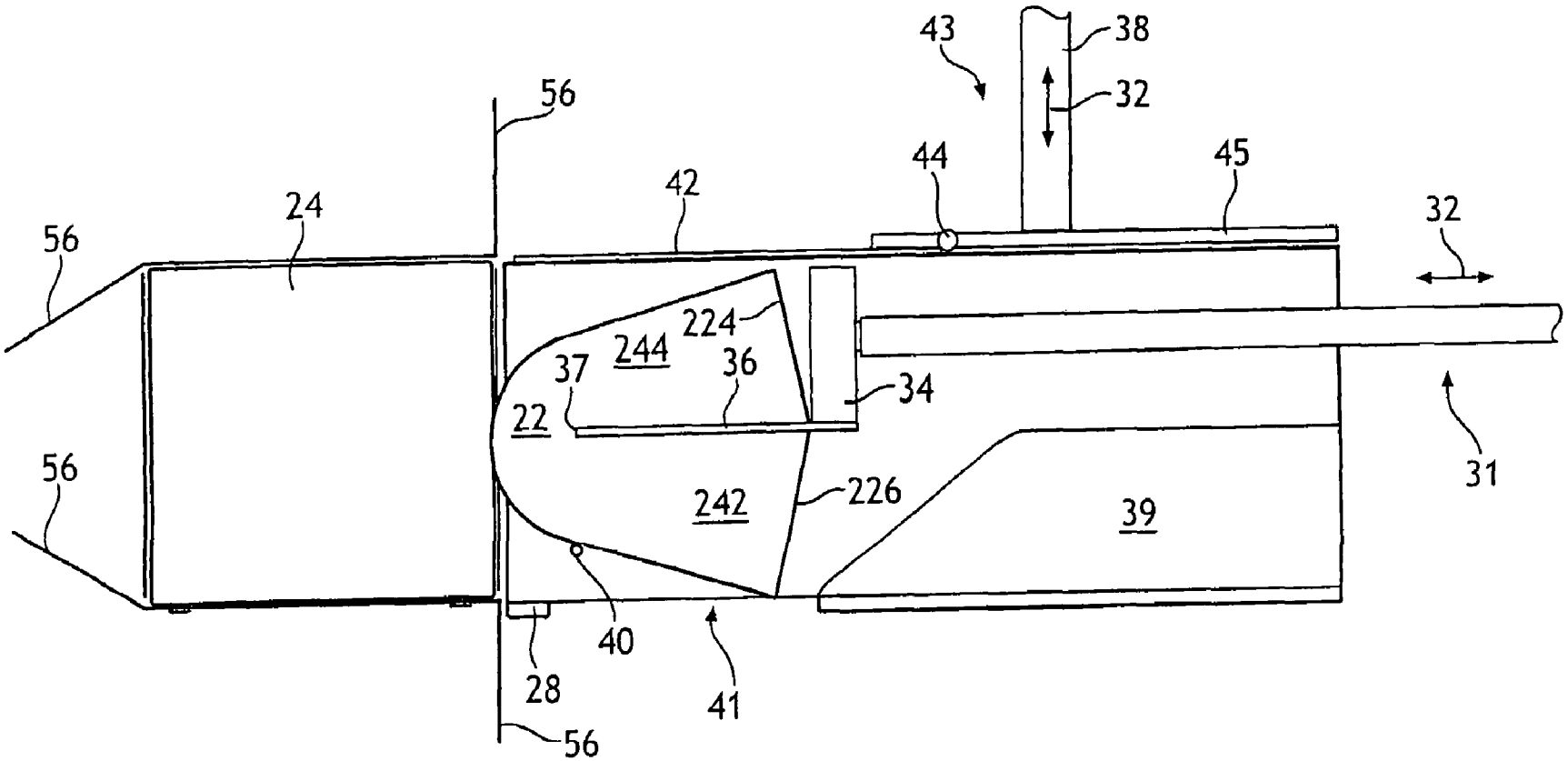

As shown in FIG. 6D, the pusher assembly 31 continues to advance pivoting the guide ramp 42 into its fully elevated position that is approximately horizontal. The folding bar 40 folds the first clip portion 242 underneath the second clip portion 244, creating either a U-shaped or J-Shaped clip. In another embodiment of the invention, the folding bar 40 is eliminated and the carton's open end can be used to fold the first clip portion 242 backwards under the folding plate 36. In another embodiment of the invention, the folding bar 40 is eliminated and the leading edge of the hole or recess 41 in the floor 28 of the bucket 26 can be used to fold the first clip portion 242 backwards under the folding plate 36.

As best seen in FIG. 5, the length of the folding plate 36, extending from the pusher head 34, is adjustable. One method to adjust the length of the folding plate is to use slotted holes and threaded fasteners to attach the plate to the head. Other mechanical elements known to those of skill in the art can be used to adjust the length of the folding plate. By extending or retracting the folding plate relative to the pusher head, the upper transverse folding axis 236 can be offset to either side of the upper transverse central axis 234 of the clip or aligned with the upper transverse central axis. This provides the flexibility to fold the clip about a transverse axis located anywhere along the length of the clip. Such flexibility can be used to load higher sheet count clips into standard sized cartons as discussed in pending U.S. patent application Ser. No. 10/955,435 entitled Folded Clip and Dispenser, filed on Sep. 30, 2004, and herein incorporated by reference.

Figure 6E:
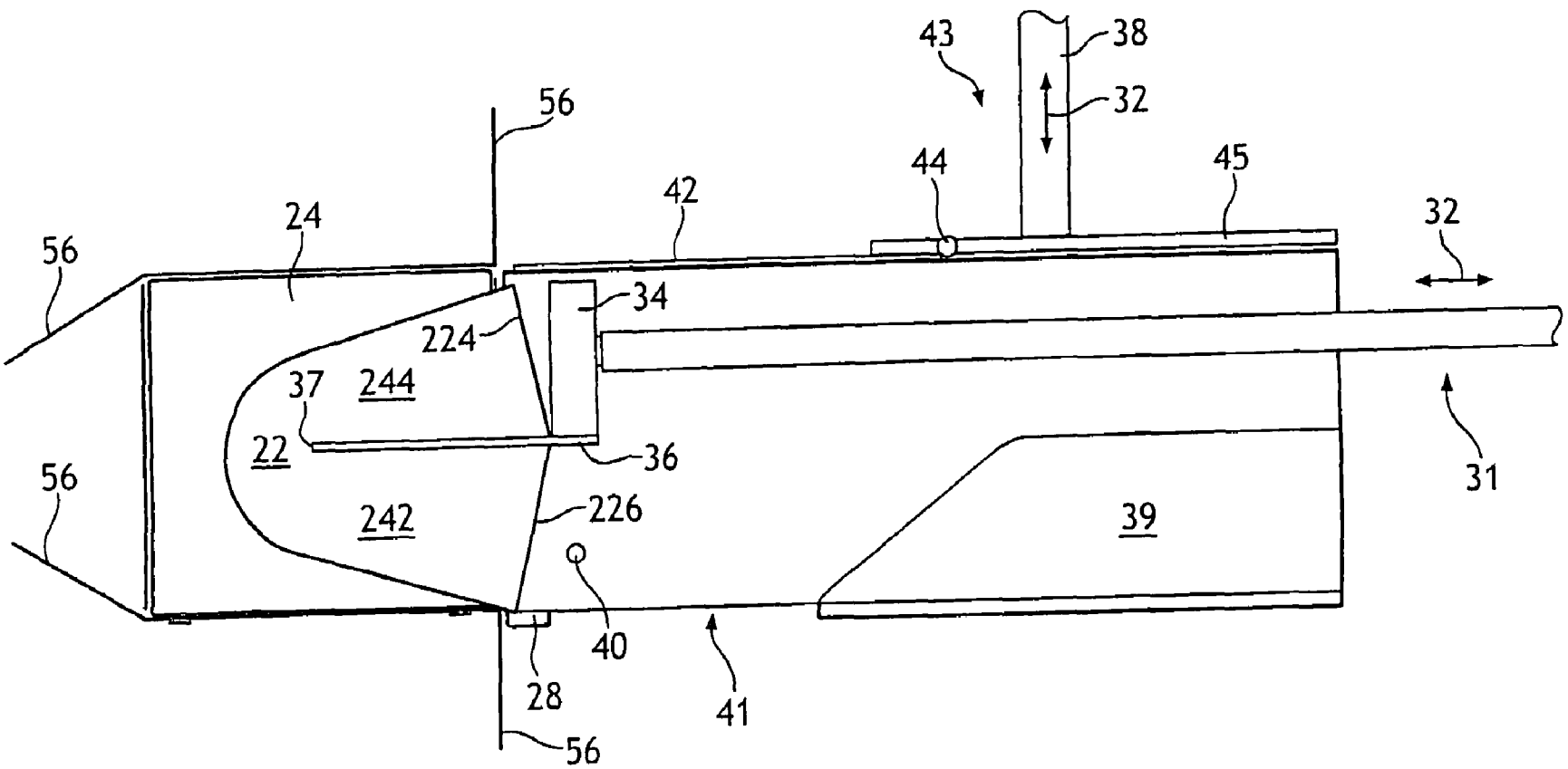

As shown in FIG. 6E, the clip loading sequence is completed as the pusher assembly 31 advances the folded clip 22 into the carton 24. Not shown, the carton 24, bucket 26, pusher assembly 31, and overhead tamper 43 continue to advance along their respective paths as the pusher assembly is retracted out of the carton. The bucket conveyor 52 and the carton conveyor 54 diverge to enable the closing flaps 56 of the carton 24 to be folded and glued shut after which the carton is removed from the carton conveyer. Upon retraction of the pusher assembly 31, the guide ramp 42 returns to its lowered position by the force of gravity or the optional torsion spring as the overhead tamper is retracted out of the bucket.

The bucket 26 continues around the bucket conveyor and returns to its initial point and a fresh clip is loaded into the bucket to start a new cycle.

Thus, for all embodiments of the invention, by loading both upright and flat tissue cartons by contacting one end (224, 226) of the clip with a pusher assembly and then advancing the clip along its longitudinal central axis 233 into the carton, a flexible clip loading apparatus can be constructed. Since the clip's orientation for uprights is identical or similar to the clip's orientation for flats, additional clip transfers or clip rotation devices are not required to run both flat and upright grades on the same machine. With a minimum of grade change time, uprights and flats can be loaded by the apparatus 20 since the clip, in both cases, is advanced into the carton by pushing on one end of the clip along the longitudinal central axis toward the carton.

Unlike upright cartoners that pre-fold the clip 22 into a U-shape before placing the clip into the bucket 26, or that place the longitudinal axis of the clip parallel the machine direction motion of the bucket conveyor, the bucket spacing or bucket pitch of the current apparatus when loading uprights can be significantly reduced since the pitch can be the same as that used to load flat cartons. The longitudinal axis of the clip for loading both flats and uprights is perpendicular to the machine direction motion of the bucket conveyor in the apparatus 20.

Closer bucket spacing provides for higher machine productivity when filling uprights, since the machine can be run at the same speed to achieve the same throughput as flats. Thus, in various embodiments of the invention, the bucket spacing or bucket pitch of the plurality of buckets 26 attached to the bucket conveyor 52 for either embodiment can be less than the longitudinal length of the clip. Alternatively, the bucket spacing can be between about 1 to about 2.3 times the width of the clip, or between about 1 to about 2.1 times the width of the clip, or between about 1 to about 1.9 times the width of the clip. In one embodiment for regular size facial tissue, the length of the clip was approximately 8.6 inches and the width was approximately 4.38 inches. Other clip sizes can be used to produce different products such as larger clips for man-sized facial tissue products.

The measured width of the clip, the size of the carton side flaps, and the bucket's sidewall thickness and degree of taper are factors that are considered when selecting the desired bucket spacing. However, irregardless of the clip's width, when folding clips as they are loaded into the cartons by pushing on the clip's end in the direction of the longitudinal central axis, the pitch of the buckets can be significantly less than by loading pre-folded clips that are pushed into the carton by the clip's side in the direction of the transverse central axis.

Another advantage of the current invention is the position of the clip within the carton 24 is more precisely controlled since the clip is prevented from rotating as the clip is loaded into the carton by the folding plate 36 as best seen in FIGS. 3F and 6E. Accurate placement of the folded clip into the carton is achieved by the folding plate 36 guiding the inside center of the folded clip into the carton. The folding plate can be lengthened or shortened to provide precise control of the transverse folding axis and the folding plate can be raised or lowered to control the position of the clip in the carton. Thus, unlike prior upright cartoners where the pre-folded clip is free to twist and move about within the bucket 26 as it is pushed into the carton, the clip is fed into the carton 24 in a very controlled manner by the folding plate 36 in the apparatus 20. While the folding plate 36 is shown horizontal in the figures, it is possible to angle the folding plate relative to the carton, or the carton relative to the folding plate, such that the clip is loaded at a predetermined angle into the carton. This can allow for more sheets to be contained by the clip without an increase in dispensing problems as discussed in the incorporated pending patent application Ser. No. 10/955,435 entitled Folded Clip and Dispenser.

Another advantage of the current invention is the possibility to control the thickness of the folding plate to fold either a tighter or loser folded clip. If the carton is too large, the folding plate can be made thicker to improve carton fill with the folded clip since the overall size of the folded clip about the folding plate will be increased. Alternatively, the folding place can be made thinner to load higher sheet count folded clips into a smaller carton. These changes can help with dispensing the sheet material from the clip.

Another advantage of the current invention is the possibility to control the shape of the free end 37 of the folding plate to create a starter sheet. For example, rather than loading the folded end 245 of the clip adjacent the dispensing opening of the carton, it may be desirable to place the first and second ends (224, 226) of the folded clip adjacent the dispensing window as discussed in the incorporated pending patent application Ser. No. 10/955,435 entitled Folded Clip and Dispenser. However, this can make it difficult to find the first sheet to dispense the sheet material. By designing the free end 37 of the folding plate 36 with a head, a shaped end, or other projection, or providing a source of vacuum to a portion of the folding plate to create a controlled vacuum contact, the free end 37 of the folding plate can drag on the sheet material in the center of the folded clip as the pusher assembly is withdrawn. By controlling the amount of drag, or vacuum force and duration, the folding plate 36 can be designed to partially withdraw at least the first sheet from the center of the folded clip. The partially withdrawn sheet can then be quickly located to start sheet dispensing when the carton is opened by the consumer.

Another advantage of the current invention is the ability to load cartons having a continuous sidewall uninterrupted by closing flaps. Such cartons are disclosed in published U.S. patent application US 2004/0144,795 entitled In-Line Windowed Facial Tissue Carton, filed by Gerry Keberlein on Jul. 3, 2003; in U.S. patent application Ser. No. 10/933,893 entitled Top Or Bottom Loading Container, filed by Duane McDonald on Sep. 4, 2004; and in U.S. patent application Ser. No. 10/933,892 entitled Top Or Bottom Loading Container, filed by Les Long et al. on Sep. 4, 2004. The disclosures of each of the preceding pending patent applications herein incorporated by reference. Because the clip is no longer rotated 90 degrees and pushed into the carton by the clip's side (228, 230), the closing flaps 56 of the carton 24 can be relocated from the carton's sides to the carton's top and bottom, as shown in FIGS. 3F and 6E. This can improve the graphical qualities of the carton when printing designs onto the sidewalls.

Another advantage of the current invention is the apparatus 20 can be selectively configured for loading both flats and uprights with a minimum of effort. The folding plate 36 and the folding bar 40 can be selectively removed from operating to fold the clip about a transverse fold axis. As used herein, "selectively removed from operating" means that the parts can be either physically removed from the apparatus or the parts can be configured to move between an operative and inoperative position while remaining attached to the apparatus.

For example, if the folding plate 36 is bolted to the pusher head 34, it can be unbolted and quickly removed. Alternatively, the pusher head can have a groove or a dovetail for the folding plate to slide within such that the folding plate can be retracted from extending past the pusher head while remaining attached to the pusher head. The folding plate can be held in the extended or retracted position by a fastener such as a spring pin that could be released to move the folding plate. Alternatively, a linear actuator could be utilized to automate the positioning of the folding plate to any position with respect to the pusher head. When the folding plate is retracted, the apparatus can be used to load flat grades.

The folding bar 40 can be selectively removed from operating as well. For example, the bucket's sidewalls 27 can have a bore, a hole, or an aperture extending through them for the folding bar to slide into. The folding bar can then be held in position by using a fastener on one or both ends. A set screw can be used to anchor the folding bar within the bores or a pair of cotter pins can be slid through holes near both distal ends of the folding bar to prevent the ends from sliding back through the holes in the sidewalls. Alternatively, the folding bar can be designed like a toilet paper spindle such that it can telescope by use of a biasing spring to extend the folding bar. The folding bar can have a pair of locating stubs and a shoulder on either end. To insert the folding bar into the bucket 26, the bar can be compressed and the locating stubs aligned with apertures located in the sidewalls 27 of the bucket. Upon releasing the folding bar, the locating stubs can extend into the apertures until the shoulders contact the sidewalls. In this manner, the folding bar can be securely held within the bucket and yet be quickly removed to load flats.

Alternatively, the folding bar can be hinged on one end to pivot and lock into a transverse position to load uprights. When loading flats, the folding bar can be pivoted out of position and locked in its inoperative storage position. For example, the sidewalls 27 of the bucket can be configured with vertical grooves. One end of the folding bar can be hinged within one groove such that the opposite end aligns with an opposing vertical groove and, when pivoted to a horizontal position, it can lock into a detent in the groove for loading uprights. To load flats, the folding bar can be rotated to a vertical position and locked into position within the other groove to minimize interference with the flat clip disposed within the bucket. For all embodiments of the folding bar, it is not required that the folding bar be round. Other geometric shapes such as oval, triangular, square, rectangular, D-shaped, or half-round can be used for the folding bar to initiate the transverse clip fold.

Similarly, the clip ramp 39 and recess 41 can be configured to be selectively removed from operating. For example, the clip ramp can be held in position by a snap fit, tabs, or spring pins such that it can be quickly removed. The bucket's floor 28 can be configured with a sliding panel or plate to cover or uncover the recess 41.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A method comprising the steps of:

placing a clip into a bucket, the clip having a longitudinal central axis passing through a first and a second end;

advancing the clip within the bucket by a pusher assembly contacting either the first or the second end of the clip, the pusher assembly moving in a direction parallel to the longitudinal central axis of the clip; and folding the clip about a transverse fold axis as the clip advances in the bucket.

2. The method of claim 1 wherein the folding comprises:

positioning the first end of the clip beneath a folding plate extending from a pusher head of the pusher assembly;

raising the second end of the clip by a guide ramp as the clip advances within the bucket;

contacting a first clip portion with a folding bar as the clip advances; and doubling back the first clip portion over the top of the folding plate as the clip advances to form the folded clip.

3. The method of claim 2 further comprising biasing the guide ramp in an elevated position by a spring.

4. The method of claim 2 further comprising retracting the pusher assembly and partially withdrawing at least a first sheet from the center of the folded clip.

5. The method of claim 2 further comprising varying the thickness of the folding plate.

6. The method of claim 2 further comprising supporting the folded clip by the folding plate and inserting the folded clip into a container.

7. The method of claim 1 wherein the folding comprises:

positioning the first end of the clip above a folding plate extending from a pusher head of the pusher assembly;

positioning the second end of the clip adjacent a clip ramp such that the second end is lower than the first end;

advancing a first clip portion into a recess or aperture in the bucket floor; and doubling back the first clip portion under the bottom of the folding plate as the clip advances to form a folded clip.

8. The method of claim 7 further comprising contacting the clip with a guide ramp positioned above the clip as the clip advances.

9. The method of claim 8 further comprising contacting the clip with a folding bar attached to the bucket as the clip advances.

10. The method of claim 7 further comprising contacting the clip with a folding bar attached to the bucket as the clip advances.

11. The method of claim 7 further comprising retracting the pusher assembly and partially withdrawing at least a first sheet from the center of the folded clip.

12. The method of claim 7 further comprising varying the thickness of the folding plate.

13. The method of claim 7 further comprising supporting the folded clip by the folding plate and inserting the folded clip into a container.

14. The method of claim 1 further comprising folding the clip into a U-shape.

15. The method of claim 1 further comprising folding the clip into a J-shape.

* * * * *